United States Patent [19]

Voreck, Jr. et al.

[11] 4,040,356

[45] Aug. 9, 1977

[54] CONVERGING WAVE DETONATOR

[75] Inventors: Wallace E. Voreck, Jr., Sparta; Everett W. Dalrymple, Randolph, both of N.J.

[73] Assignee: The United States of America as represented by the Secretary of the Army, Washington, D.C.

[21] Appl. No.: 702,560

[22] Filed: July 6, 1976

[51] Int. Cl.[2] ..... F42B 3/10

[52] U.S. Cl. ..... 102/28 R; 102/DIG. 2

[58] Field of Search ..... 102/28 R, DIG. 2

[56] References Cited

U.S. PATENT DOCUMENTS

| | | | |
|---|---|---|---|
| 2,767,655 | 1/1956 | Seavey | 102/28 R |
| 2,987,997 | 6/1961 | Ireland, Jr. | 102/28 R |
| 3,182,592 | 5/1965 | Barocca | 102/28 R |
| 3,726,217 | 4/1973 | Dedman et al. | 102/28 R |
| 3,820,461 | 6/1974 | Silvia | 102/DIG. 2 |

*Primary Examiner*—Charles T. Jordan

*Attorney, Agent, or Firm*—Nathan Edelberg; A. Victor Erkkila; Max Yarmovsky

[57] ABSTRACT

A detonator fuze train combination utilizes a thin centrally initiated disc shaped lead azide primer's detonation waves reflected from interior walls of a circumambient metal cup shaped housing member to peripherally detonate a secondary output charge. The output charge produces a detonation wave which converges radially inwardly to generate an enhanced jet output. The resultant jet output is capable of initiating a remotely positioned, RDX, high explosive acceptor.

7 Claims, 3 Drawing Figures

CONVERGING WAVE DETONATOR

GOVERNMENTAL INTEREST

The invention described herein may be manufactured, used and licensed by or for the Government for governmental purposes without the payment to me of any royalty thereon.

BACKGROUND OF THE INVENTION

Various means have been used in prior art to provide for detonation of a high explosive. Prior art explosive detonators generally utilize an impact type primer or an electrically activated primer to initiate a lead azide train or a pyrotechnic delay train to ignite a booster charge and in turn to fire the main high explosive charge. One problem with these prior art devices was that the primer-lead azide train-detonator size requirements were frequently too large to be accommodated within the space limitations imposed by fuzes. The problem of space limitation is particularly vexing in applications where the munition has a plurality of sub-munitions contained therein. Another problem with the above-mentioned prior art detonators was that they frequently were unreliable and unsafe because of their sensitivity to stray electrical currents, the failure of any one of a multitudinous of electrical connections, failure in movement or function of an essential part because of the influence of a high acceleration environment, or a failure due to contamination or corrosion caused by loss of hermeticity.

SUMMARY OF THE INVENTION

The present invention relates to a converging wave detonator of TO-104 to a TO-5 size which utilizes a metal housing welded to a lead-header assembly to hermetically enclose a thin disc shaped layer of lead azide intermediate an electrical igniter assembly and a thin disc shaped layer of secondary output charge such as, cyclotetramethylenetetranitramine, HMX. The present invention is designed so that the thin lead azide layer is too short to initiate an output charge such as HMX directly. A plot of average denting ability, %, detonator output, versus lead azide thickness in thousandths of an inch are shown in FIG. 1. From test results and the plot, it has been empirically determined that for detonators having lead azide layers less than 0.040 thousandths of an inch thick, the denting ability is less than 5% of the full detonator output and that this impact force is insufficient to directly initiate a secondary high explosive such as HMX or cyclonite, RDX.

An object of the present invention is to provide a detonator which has a very short overall length so that it can be efficiently used in a submunition.

Another object of the present invention is to provide a small size detonator which has an output capability of effectively jumping a substantial distance gap to initiate a high explosive such as RDX which is proximately disposed therefrom.

Another object of the present invention is to provide a detonator having a primer member which, because of its thickness, is not capable of directly initiating a secondary output charge in the center.

Another objective of the present invention is to provide a detonator and integrated igniter which is effective in initiating an RDX explosive and which fits into the top of an integrated circuit enclosure having a TO-104 to TO-5 size.

Another object of the present invention is to provide a combined detonator and igniter assembly in a hermetically sealed container which is not influenced by stray electrical signals.

Another object of the present invention is to provide a combined converging wave detonator and igniter assembly in a hermetically sealed container which is of reduced size and cost.

Another object of the present invention is to provide a combined detonator and igniter assembly which has increased resistance to spin and setback acceleration environments.

A further object of the present invention is to provide a combined converging wave detonator and igniter assembly in a container which is hermetically sealed against ambient environmental conditions.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
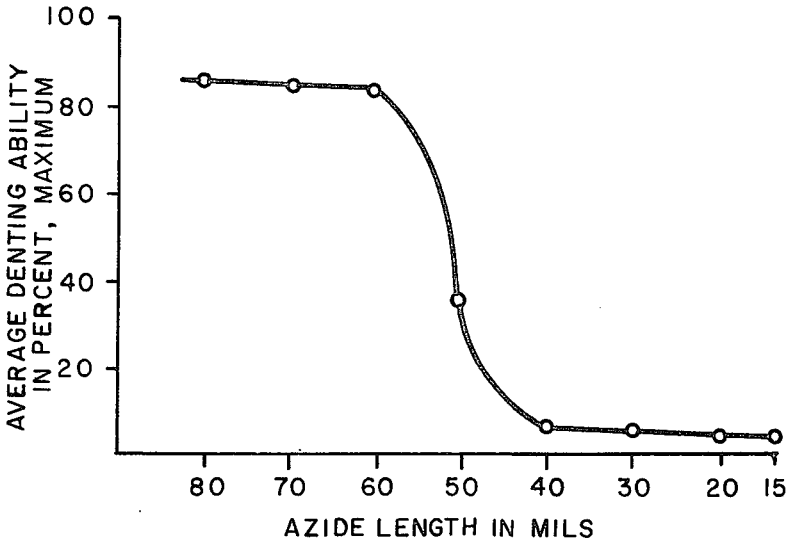
FIG. 1 is a plot of average denting ability in percent versus lead azide primer length.
Figure 2:
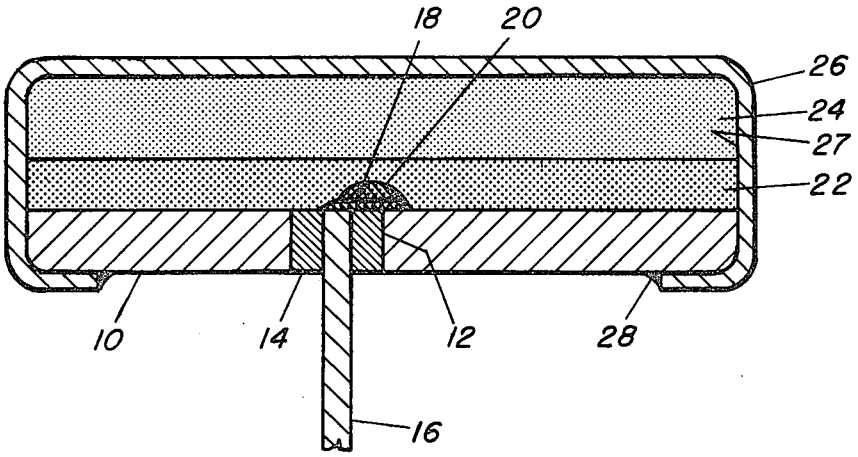
FIG. 2 is a diametral longitudinal cross-sectional view of the combined converging wave detonator and igniter assembly in a hermetically sealed housing.

Referring now in FIG. 2 a disc shaped metal header 10 has an axial transverse insulator bore 12 therein which hermetically contains a tubular insulator 14 and a lead post 16 which passes through the insulator 14 and is hermetically sealed thereto. A bridge wire 18 is fixedly electrically connected on one end to the top of axially disposed lead post 16 and on its other end to header member 10. A hemispherical ignitor spot charge 20 made of material such as, lead styphnate, is operatively positioned on top of the igniter bridge wire 18. A disc shaped layer of primer charge member 22, made of material such as lead azide, approximately 0.015 of an inch thick, is disposed on top of the igniter-header assembly aforedescribed. A disc shaped secondary output charge member 24, made of material such as HMX, approximately 0.040 of an inch thick, is positioned on top of the primer member 22. A circumambient metal housing 26 of 0.2 to 0.3 of an inch in diameter, is hermetically sealed to header member 10 at the solder circular fillet 28. The metal header 26 serves as the ground connection for the device.

Figure 3:
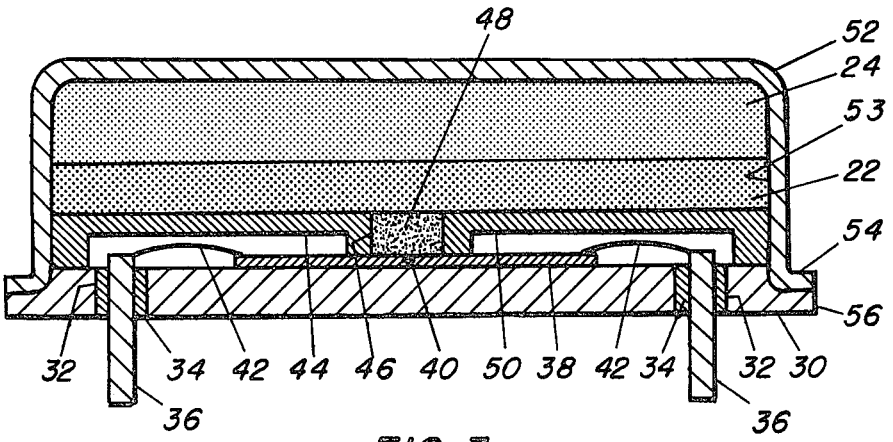
FIG. 3 is a diametral longitudinal cross-sectional view of an alternate embodiment of the combined converging wave detonator and igniter assembly in a hermetically sealed housing.

FIG. 3 shows an alternate embodiment of the converging wave detonator design described in FIG. 2. In this design a multiple lead metal header 30 has a number of head insulator holes 32 therein. Tubular insulators 34 having header leads 36 are sealed into header 30 to make a leak tight header assembly. An electrical igniter integrated circuit chip 38 is centrally positioned on the interior surface of the header 30 so that an igniter hot spot 40 is axially positioned on the header 30. Header leads 36 are electrically connected to the igniter integrated circuit chip by means of electrical conductors 42.

The electronic igniter integrated circuit chip includes R.F. bypass means, an electronic logic system, and switching means to enable generation of a hot spot 40 only upon application of an intended input signal to leads 36. A disc shaped insulator element 44 having an axial hole 46 therein is axially aligned with the igniter-header assembly and positioned thereon. A lead styphnate cylindrical igniter charge element 48 is positioned within the axial hole 46 so that it is in direct contact with the igniter hot spot 40. The insulator 44 has an annular groove 50 therein which permits clearance between the bottom wall surface of the insulator 44 and the interior surface of the header 30 so that the electrical conductors 42 and integrated circuit chip 38 are not disturbed by the positioning of insulator 44 thereover.

In a similar fashion to the detonator of FIG. 2, a thin disc shaped primer charge member 22, made of such material as lead azide, is positioned on top of the insulator 44 and the lead styphnate igniter, and a disc shaped secondary output charge member 24, made of such material as HMX is positioned on top of the primer charge 22. A cup shaped metal housing 52 having a flange 54 thereon is ring welded to header shoulder 56 to form a hermetic sealed detonator.

In operation, the detonators of FIGS. 2 and 3 are initiated when the lead styphnate 20 and 48 is ignited by a hot wire or an integrated circuit hot spot respectively after application of a proper input voltage to the lead 16 and 36 respectively. Other initiating sources that would be suitable for use as an igniter are an exploding wire, a conductive mixture, or a mild detonating cord. The initial detonation wave produced in the lead azide primer charge layer 22, because of the thin cross-section, is not sufficient to initiate the secondary output charge 24 directly. The detonation wave propagates radially outward from the center until it hits the interior walls 27 and 53 of housings 26 and 52, respectively. The reflected shock waves causes pressure to increase to a level which causes annular initiation of secondary output charges 24 at their outer edges. The detonation of the secondary output charges 24 then propagates in a converging detonation wave which collides in the center of the device producing an axial jet of explosion materials whose energy is effective in initiating a high explosive, RDX, acceptor (not shown) across an air gap of approximately ⅜ of an inch. In the specific embodiments illustrated in FIGS. 2 and 3 of the metal housings 26 and 52 are made of steel with a wall thickness of at least 0.010 inch. The secondary output charges 24 are made of 80 mg. HMX material pressed at 25,000 psi to give the desired thickness of 0.040 inch. The primer charges 22 are made of 60 mg lead azide charge pressed at 25,000 psi to give the desired thickness of 0.015 inch.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A converging wave detonator which comprises:

means for housing said detonator therein and for reflecting an outwardly radially radiating detonation wave from the interior walls thereof;

lead-header means for hermetically sealing with said means for housing and for providing electrical connection therethrough;

means for igniting said detonator being centrally disposed on said lead-header means for sealing and enclosed within said means for housing;

a disc shaped lead azide primer charge member axially aligned with and operatively disposed on said means for igniting; and a disc shaped secondary output charge member operatively disposed on said primer charge member;

wherein, in initial detonation wave, centrally produced in said lead azide primer charge by said means for igniting, propagates radially outward from said lead azide primer charge until said detonation wave hits the interior walls of said means for housing generating a reflected shock wave which causes pressure within said means for housing to increase to a level which in turn causes annular initiation at the outer edges of said secondary output charge and the generation of a converging detonation wave in said secondary output charge which after colliding in the center of said secondary output charge produces an axial jet of explosion materials capable of initiating a high explosive acceptor made of material such as RDX.

2. A converging wave detonator as recited in claim 1 wherein said means for housing comprises a steel cup shaped member having a wall thickness of at least 0.01 inch.

3. A converging wave detonator as recited in claim 1 wherein said means for hermetically sealing with said means for housing comprises:

a disc shaped metal header having at least one insulator hole therethrough;

a tubular insulator hermetically sealed in said insulator hole; and an electrical conductor passing through said tubular insulator and hermetically sealed therein, for providing electrical current to said means for igniting said detonator.

4. A converging wave detonator as recited in claim 1 wherein said disc shaped lead azide primer is made of a 60 milligram charge pressed at 25,000 psi to a cross-sectional thickness of less than 0.015 of an inch.

5. A converging wave detonator as recited in claim 1 wherein said disc shaped secondary output charge member is made of 80 milligram cyclotetramethylenetetranitramine pressed at 25,000 psi and having a cross-sectional thickness of less than 0.040 of an inch.

6. A converging wave detonator as recited in claim 1 wherein said means for igniting said detonator comprises:

a bridge wire having a first end fixedly electrically connected to said electrical conductor and another end electrically coupled to said metal header;

a lead styphnate igniter spot charge centrally positioned on top of said bridge wire, said igniter spot charge being disposed intermediate said primer charge member and said metal header and substantially in the center of said detonator.

7. A converging wave detonator as recited in claim 1 wherein said means for igniting said detonator comprises:

an integrated circuit chip centrally disposed on an interior surface of said lead-header means and electrically coupled thereto, said integrated circuit chip having an axially positioned igniter hot spot positioned thereon;

a disc shaped insulator element having an axial hole therein, said insulator element being positioned intermediate said lead header means and said lead azide primer charge member;

a lead styphnate cylindrical igniter charge element positioned in the axial hole of said disc shaped insulator element intermediate said lead azide primer charge member and the igniter hot spot of said integrated circuit chip.

* * * * *